US009169776B2

(12) United States Patent
Chang

(10) Patent No.: US 9,169,776 B2
(45) Date of Patent: Oct. 27, 2015

(54) CYLINDER LINER USED FOR MODEL ENGINE

(71) Applicant: GOLDEN LION ENTERPRISE CO., LTD., Taichung (TW)

(72) Inventor: Lien-Sheng Chang, Taichung (TW)

(73) Assignee: GOLDEN LION ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 14/591,699

(22) Filed: Jan. 7, 2015

(65) Prior Publication Data

US 2015/0192063 A1 Jul. 9, 2015

Related U.S. Application Data

(63) Continuation-in-part of application No. 14/151,241, filed on Jan. 9, 2014, now abandoned.

(51) Int. Cl.

| | |
|---|---|
| ***F02F 1/20*** | (2006.01) |
| ***F02B 75/34*** | (2006.01) |
| ***F02F 1/00*** | (2006.01) |
| ***F01M 11/02*** | (2006.01) |

(52) U.S. Cl.

CPC ..... *F02B 75/34* (2013.01); *F01M 11/02* (2013.01); *F02F 1/004* (2013.01)

(58) Field of Classification Search

CPC ..... F02F 1/004; F02F 2001/006; F02F 1/20; F01M 2011/022

USPC ..... 123/193.6

See application file for complete search history.

(56) References Cited

U.S. PATENT DOCUMENTS

2002/0090155 A1* 7/2002 Ushijima et al. ..... 384/293

* cited by examiner

*Primary Examiner* — Lindsay Low
*Assistant Examiner* — Kevin Lathers
(74) *Attorney, Agent, or Firm* — Ming Chow; Sinorica, LLC

(57) ABSTRACT

A cylinder liner capable of oil storage and lubrication used for a model engine is provided. The cylinder liner is disposed in a cylinder of the model engine. A piston is provided in the cylinder liner to reciprocate axially. The inner wall of the cylinder liner is honed to form a plurality of grooves. The inner wall of the cylinder liner is further formed with at least one grooved trough. The grooved trough is adapted to store an oil film to provide a lubrication effect between the piston and the cylinder liner during the reciprocation of the piston. The present invention enhances the protection for the piston and the cylinder liner and lowers the temperature during the running of the model engine. The piston can be reciprocated smoothly for a long time at a high speed so as to enhance the efficiency and service life of the engine.

3 Claims, 12 Drawing Sheets

CYLINDER LINER USED FOR MODEL ENGINE

The current application is a continuation-in-part that claims a priority to the U.S. Utility patent application Ser. No. 14/151,241 filed on Jan. 9, 2014.

BACKGROUND OF THE INVENTION

1. Field of the Invention

The present invention relates to a model engine, and more particularly to a cylinder liner capable of oil storage and lubrication used for a model engine.

2. Description of the Prior Art

FIG. 1 is a schematic view of a conventional model engine. The model engine comprises an engine main body 1. The engine main body 1 is longitudinally provided with a cylinder liner 2. A piston 3 is provided in the cylinder liner 2. The piston 3 is movable in the cylinder liner 2 in the axial direction of the cylinder liner 2. The piston 3 is further connected with a connecting rod 4. One end of the connecting rod 4 is pivotally connected under the piston 3. The connecting rod 4 extends downward to extend out of the cylinder liner 2. The other end of the connecting rod 4 is pivotally connected with a crankshaft 5. The crankshaft 5 is transversely disposed under the cylinder liner 2 and extends out of the engine main body 1. Thereby, when the model engine is running, the piston 3 is reciprocated in the cylinder liner 2 to bring the crankshaft 5 to turn through the connecting rod 4, so that the power generated by the model engine is outputted through the crankshaft 5.

FIG. 2 is a partial sectional view of the cylinder liner and the piston of the conventional model engine. FIG. 3 is a partial enlarged view of the cylinder liner of the conventional model engine. When the model engine is running, the piston 3 must be close contact with the cylinder liner 2 for the energy generated by explosion of the oil film in the cylinder liner 2 to convert into kinetic energy to reciprocate the piston 3, preventing the kinetic energy generated by explosion of the oil film from overflowing through the gap between the piston 3 and the cylinder liner 2. However, when the piston 3 is reciprocated in the cylinder liner 2, the reciprocation of the piston 3 will bear great damping if the frictional resistance between the piston 3 and the cylinder liner 2 is too large. This causes a high temperature and reduces the power output efficiency of the model engine. In order to avoid the aforesaid situation, the inner wall of the cylinder liner 2 is honed to form a plurality of oblique cross groves a. The depth of the grooves a on the inner wall of the cylinder liner 2 is very shallow in the range of 0.001 to 0.002 centimeter. Both Chinese Patent Publication No. 102189502 and U.S. Pat. No. 5,549,086 disclose the method to form the grooves a on the inner wall of the cylinder liner 2. The grooves a formed by honing processing not only keep close contact between the piston 3 and the cylinder liner 2 but also decrease the contact area of the piston 3 and the inner wall of the cylinder liner 2. The ragged surface formed by the grooves a on the inner wall of the cylinder liner 2 has the function to store the oil film so as to increase the lubrication effect and to reduce the frictional resistance to lower the temperature.

For keeping close contact between the piston 3 and the cylinder liner 2, the depth of the grooves a on the inner wall of the cylinder liner 2 is limited to in the range of 1 to 2 micrometers, such that the lubrication effect by storing the oil film is limited.

In view of this, another engine is developed accordingly. FIG. 4 is a partial sectional view of another conventional cylinder liner and the piston. FIG. 5 is a partial enlarged view of the cylinder liner. The outer wall of the piston 6 is provided with a plurality of annular members 7 to accumulate an oil film when the piston 6 is reciprocated in the cylinder liner 2. Through the accumulated oil film, when the piston 6 is reciprocated, a layer of oil film is formed between the piston 6 and the inner wall of the cylinder liner 2 to achieve a lubrication effect so as to lower the damping when the piston 6 is reciprocated. The annular members 7 fitted on the outer wall of the piston 6 cause a gap between the piston 6 and the wall of the cylinder, and they may be degraded and deformed easily to result in the loss of the compression ratio of the engine. The power output efficiency of the engine is reduced, so the engine needs further improvement.

FIG. 6 is a sectional view of a further conventional cylinder liner and the piston. FIG. 7 is a partial sectional view of the cylinder liner. The outer wall of the piston 8 is formed with a plurality of grooves 9. The grooves 9 are adapted to store an oil film. When the piston 8 is reciprocated in the cylinder liner 2, the oil film stored by the grooves 9 forms a layer of oil film between the piston 8 and the inner wall of the cylinder liner 2 to provide a lubrication effect so as to lower the damping when the piston 8 is reciprocated. Because the piton 8 is a movable part, the oil film stored by the grooves 9 is easily flung out by the centrifugal force caused by the reciprocation of the piston 8. Thus, the oil film stored by the grooves 9 cannot continue to provide the lubrication effect. This results in an increase of the frictional resistance to bear great damping during the piston 8 is reciprocated. In particular, when the piston 8 is reciprocated at a high speed, the centrifugal force is greater and the oil film in the grooves 9 is flung out constantly. The grooves 9 are almost impossible to store the oil film, so the lubrication effect is not good. Accordingly, the inventor of the present invention has devoted himself based on his many years of practical experiences to solve these problems.

SUMMARY OF THE INVENTION

The primary object of the present invention is to provide a cylinder liner capable of oil storage and lubrication used for a model engine to enhance and keep a lubrication effect effectively. The present invention lowers the temperature and enhances the protection for the piston and the cylinder liner and during the running of the model engine. The piston can be reciprocated smoothly for a long time at a high speed so as to enhance the efficiency and service life of the engine.

In order to achieve the aforesaid object, the inner wall of the cylinder liner is further radially formed with at least one grooved trough. The depth of the grooved trough formed on the inner wall of the cylinder liner is in the range of 3 to 5 micrometers.

The grooved trough is adapted to store an oil film to provide a lubrication effect between the piston and the cylinder liner during the reciprocation of the piston. The present invention enhances the protection for the piston and the cylinder liner and lowers the loss during the running of the model engine. The piston can be reciprocated smoothly for a long time at a high speed so as to enhance the efficiency and service life of the engine.

DETAILED DESCRIPTION OF THE PREFERRED EMBODIMENTS

Embodiments of the present invention will now be described, by way of example only, with reference to the accompanying drawings.

Figure 1:
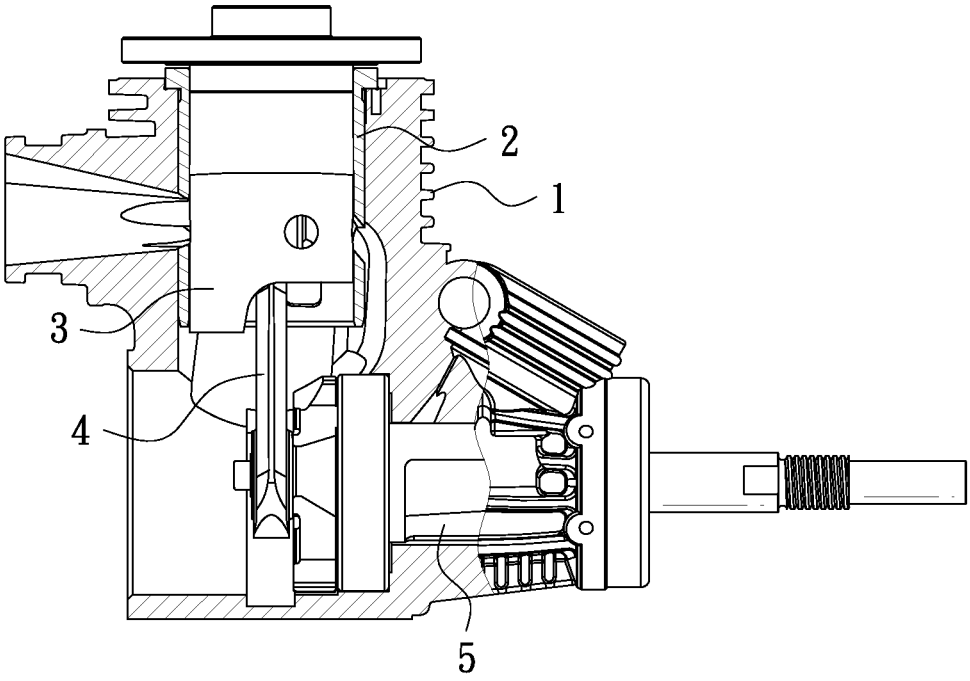
FIG. 1 PRIOR ART
FIG. 1 is a sectional schematic view of a conventional model engine.
Figure 2:
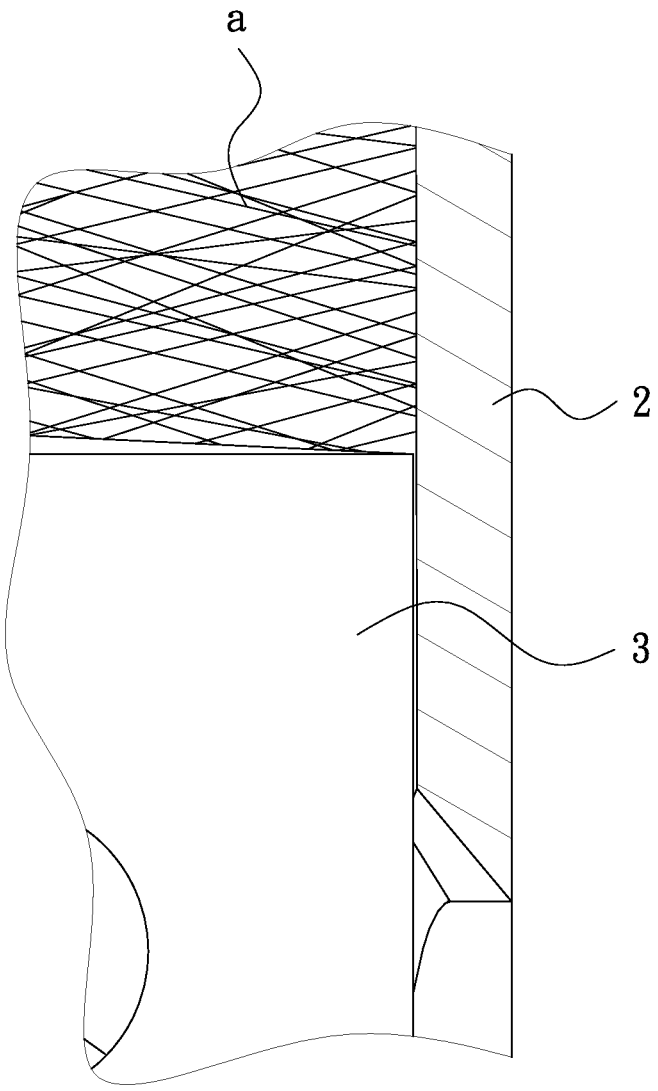
FIG. 2 is a partial sectional view of the cylinder liner and the piston of the conventional model engine.
Figure 3:
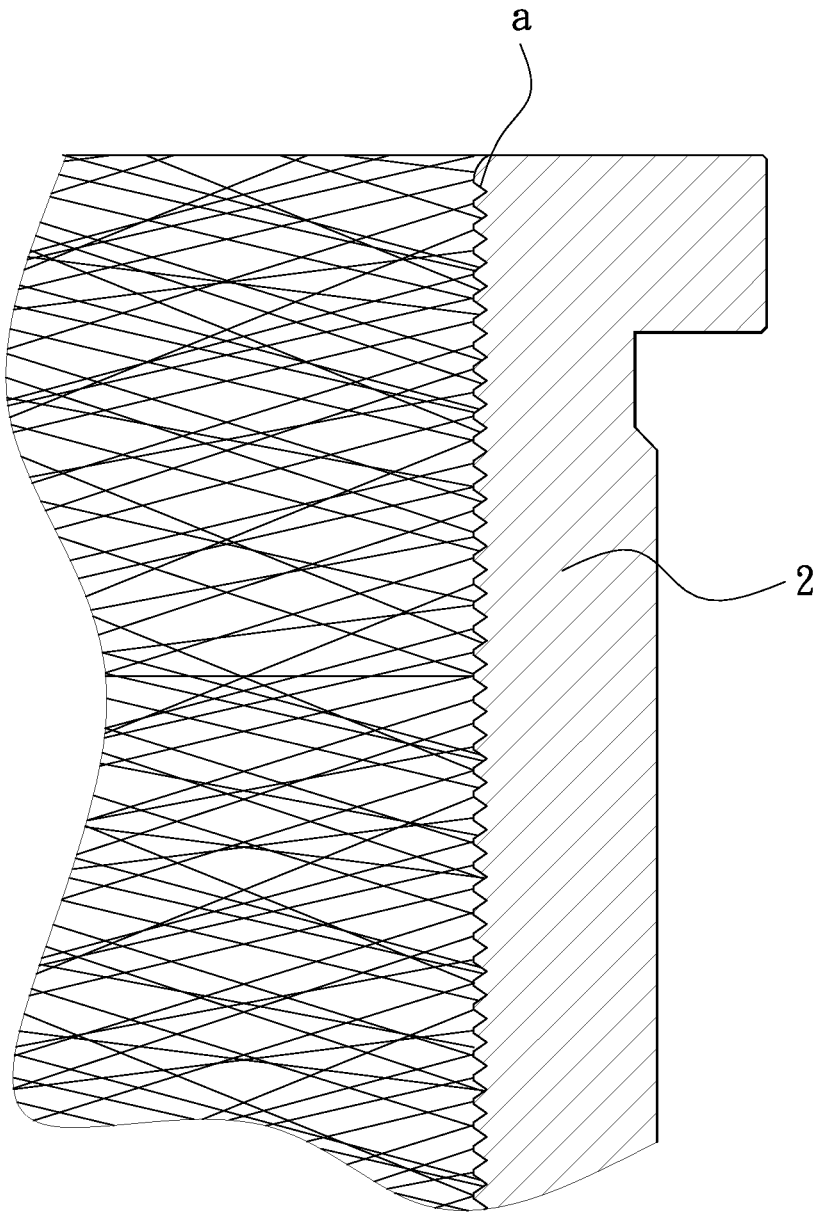
FIG. 3 is a partial enlarged view of the cylinder liner of the conventional model engine.
Figure 4:
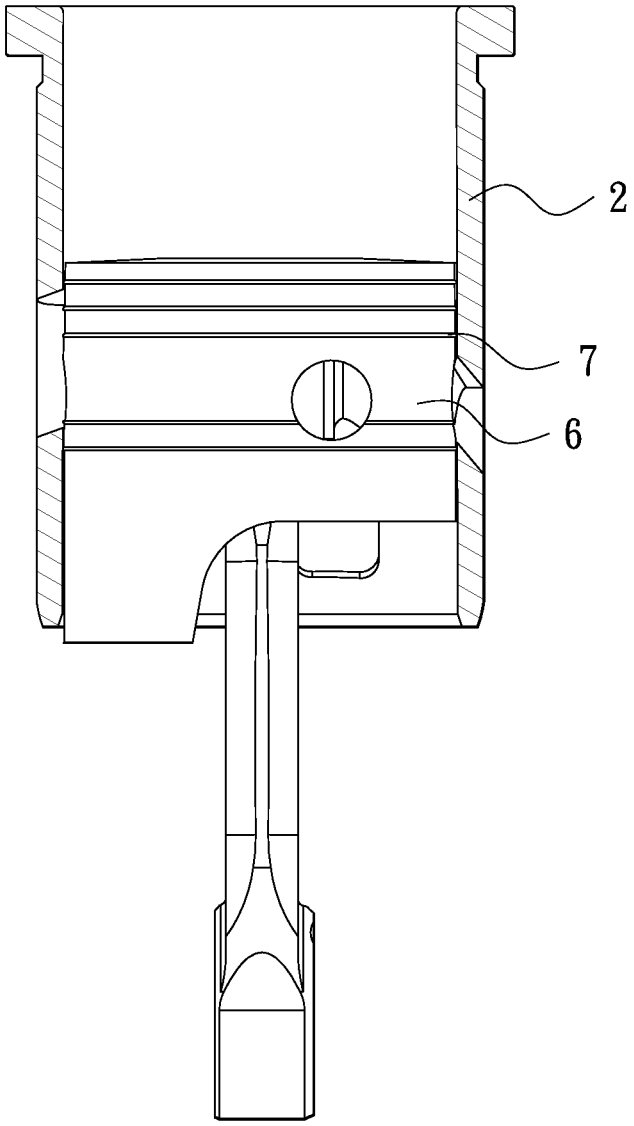
FIG. 4 is a sectional view of another conventional cylinder liner and the piston.
Figure 5:
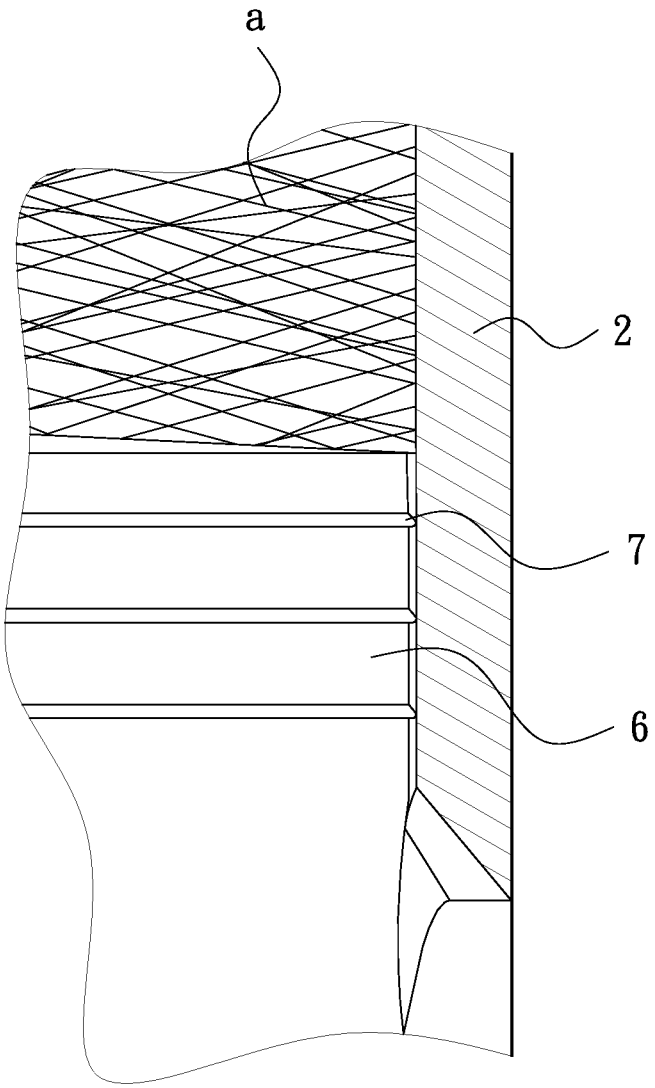
FIG. 5 is a partial enlarged view of the cylinder liner.
Figure 6:
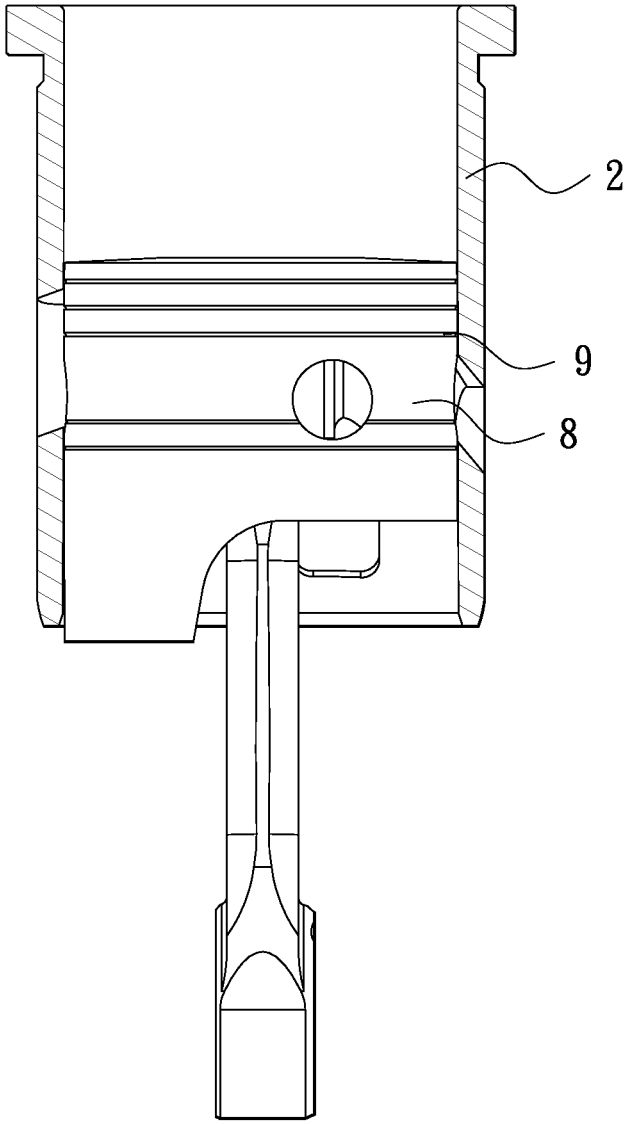
FIG. 6 is a sectional view of a further conventional cylinder liner and the piston.
Figure 7:
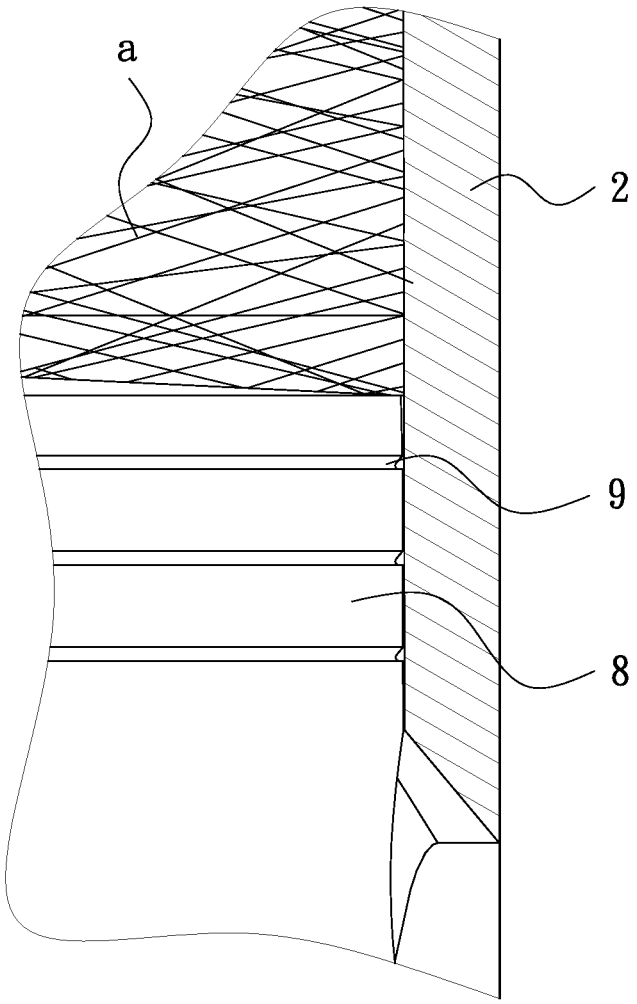
FIG. 7 is a partial sectional view of the cylinder liner.
Figure 8:
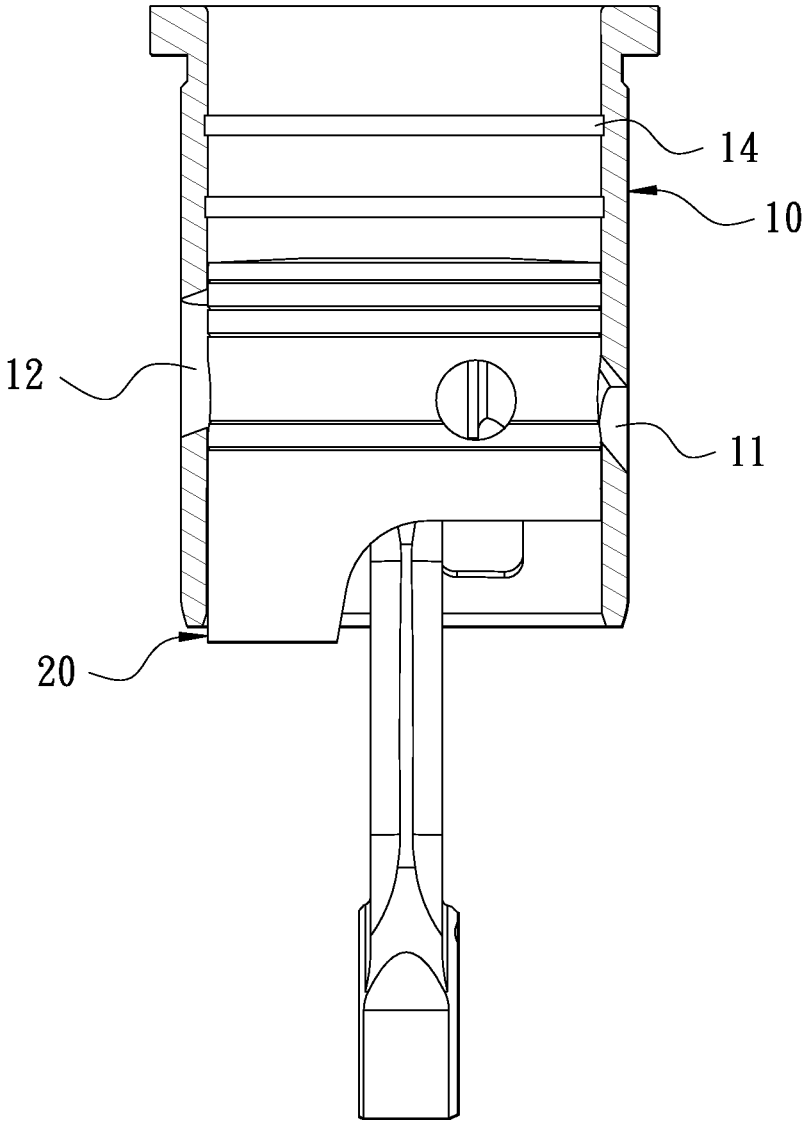
FIG. 8 is a sectional view of the cylinder liner and the piston of the present invention.
Figure 9:
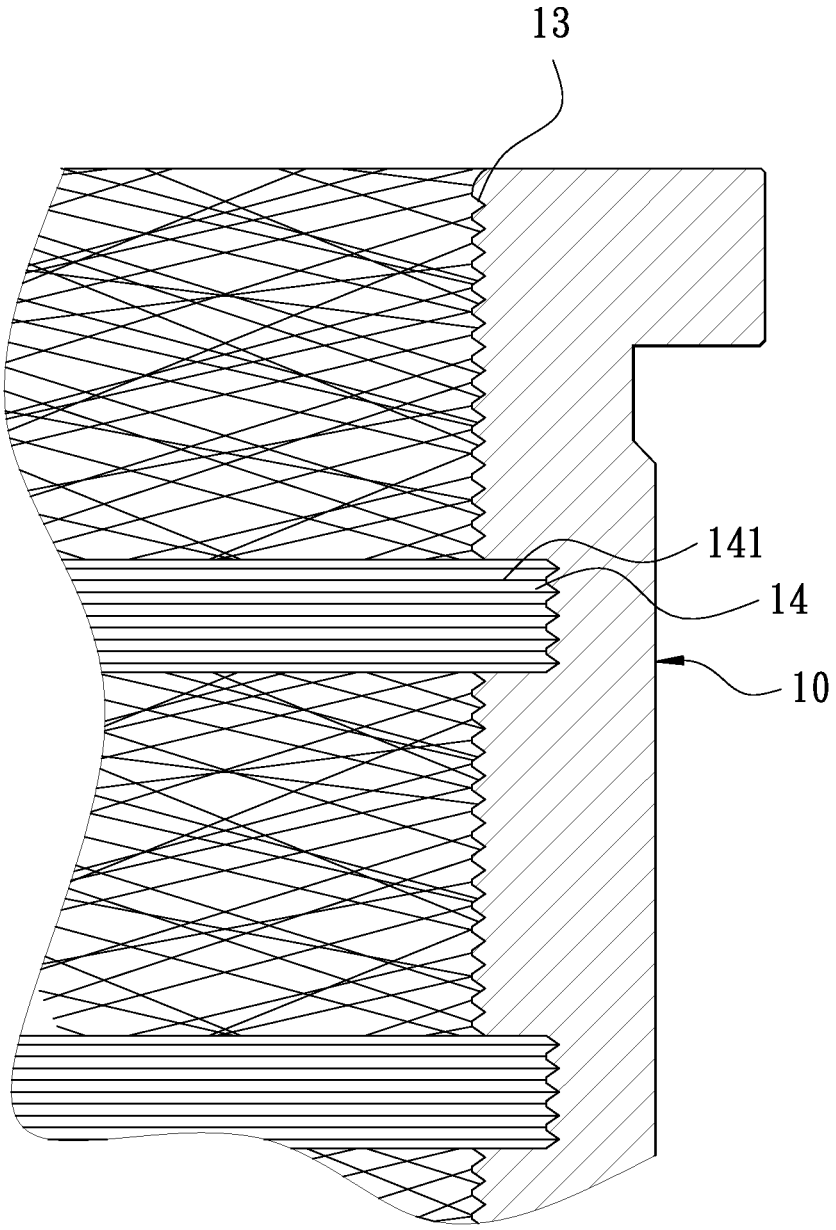
FIG. 9 is a partial enlarged view of the cylinder liner of the present invention.
Figure 10:
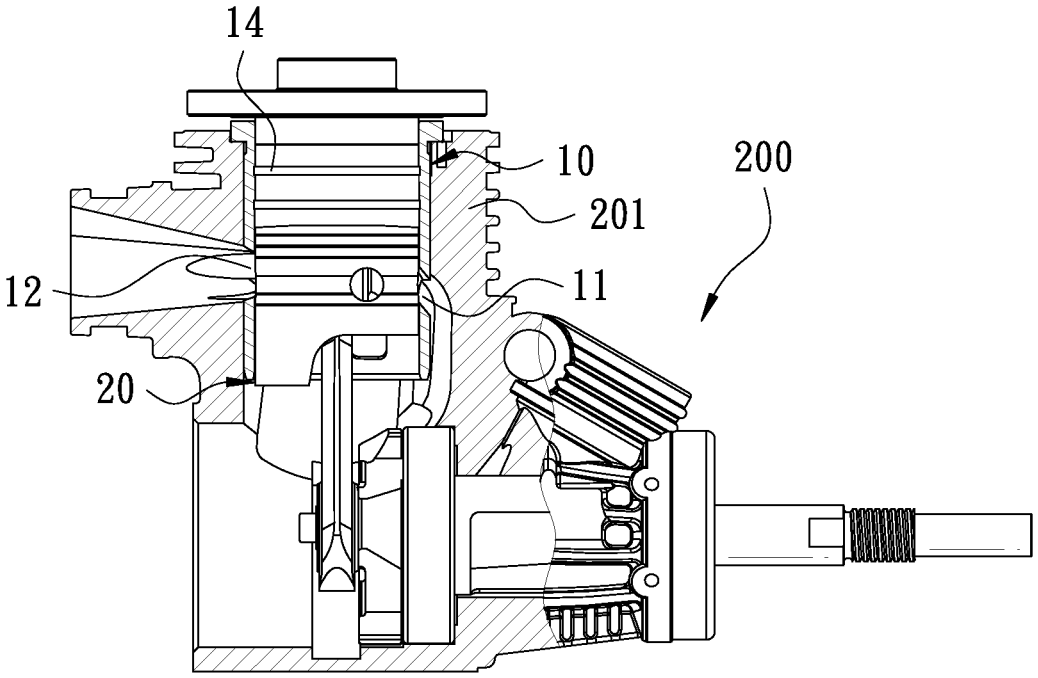
FIG. 10 is a sectional view showing the present invention mounted in the model engine.

As shown in FIG. 8 to FIG. 10, the present invention discloses a cylinder liner 10 capable of oil storage and lubrication used for a model engine. The cylinder liner 10 is substantially in a cylindrical shape. The cylinder liner 10 is disposed in a cylinder 201 of a model engine 200. A piston 20 is provided in the cylinder liner 10 to reciprocate axially. An axial lower portion of the cylinder liner 10 is formed with an air inlet 11 and an air outlet 12. The air outlet 12 is disposed opposite the air inlet 11. It is noted that the inner diameter of the cylinder liner 10 is gradually reduced from the lower portion of the cylinder liner 10 toward the upper portion of the cylinder liner 10 along the axial direction of the cylinder liner 10, such that the inner diameter of the upper portion of the cylinder liner 10 is slightly less than the inner diameter of the lower portion of the cylinder liner 10. The inner wall of the cylinder liner 10 is honed to form a plurality of grooves 13. The depth of the grooves 13 on the inner wall of the cylinder liner 10 is very shallow in the range of 0.001 to 0.002 centimeter. The above-mentioned configuration of the cylinder liner 10 is prior art, and won't be described hereinafter.

The main improved feature of the present invention is that the inner wall of the cylinder liner 10 is further formed with two grooved troughs 14. The grooved troughs 14 are radially annularly disposed on the inner wall of the cylinder liner 10, namely, the grooved troughs 14 are annularly disposed on the inner wall of the cylinder liner 10 in the radial direction of the cylinder liner 10. The bottom of the grooved trough 14 is formed with a plurality of transverse stripes 141 by turning, such that the bottom of the grooved trough 14 is ragged. The depth of the grooved troughs 14 formed on the inner wall of the cylinder liner 10 is greater than the depth of the grooves 13. The depth of the grooved troughs 14 is in the range of 0.005 to 0.007 centimeter. The width of each grooved trough 14 is about 1 centimeter. The distance between the two grooved troughs 14 is in the range of 2 to 3 centimeters.

FIG. 10 is a sectional view showing the present invention mounted in the model engine. The cylinder liner 10 is disposed in the model engine 200. When the model engine 200 is running, the oil film mixed by the fuel oil and the air is injected into the cylinder liner 10 through the air inlet 11. At this moment, the piston 20 is located at the lower portion of the cylinder liner 10 in a rising state to compress the oil film toward the upper portion of the cylinder film 10. When the oil film is compressed upward by the piston 20, the surface of the inner wall of the cylinder liner 10 is formed with a layer of oil film to provide a lubrication effect between the piston 20 and the inner wall of the cylinder liner 10. In the meanwhile, the oil film is diffused to the grooved troughs 14 and stored in the grooved troughs 14. Thereby, during the reciprocation of the piston 20, the oil film stored in the grooved troughs 14 is adhered to the surface of the outer wall of the piston 20 when the piston 20 passes through the grooved troughs 14 to form a layer of oil film. The transverse strips 141 of the grooved troughs 14 are to enhance the adherence of the oil film. The oil film stored in the grooved troughs 14 continues to provide a better lubrication effect between the piston 20 and the cylinder liner 10. The present invention enhances the protection for the piston 20 and the cylinder liner 10 and lowers the temperature and loss during the running of the model engine 200. The piston 20 can be reciprocated smoothly for a long time at a high speed so as to enhance the efficiency and service life of the engine.

It is noted that the depth of the grooved troughs 14 is in the range of 0.005 to 0.007 centimeter. This can store the oil film to provide a lubrication effect, and during the reciprocation of the piston 20, the piston 20 is close contact with the cylinder liner 10. There is no loss of the compression ratio to influence the power output of the model engine.

The inner diameter of the cylinder 10 is gradually reduced from the lower portion of the cylinder liner 10 toward the upper portion of the cylinder liner 10 along the axial direction of the cylinder liner 10. During the reciprocation of the piston 20, the upper portion of the cylinder liner 10 forces the cylinder liner 10 to tighten the piston 20 to enhance the oil storage effect of the grooved troughs 14.

Figure 11:
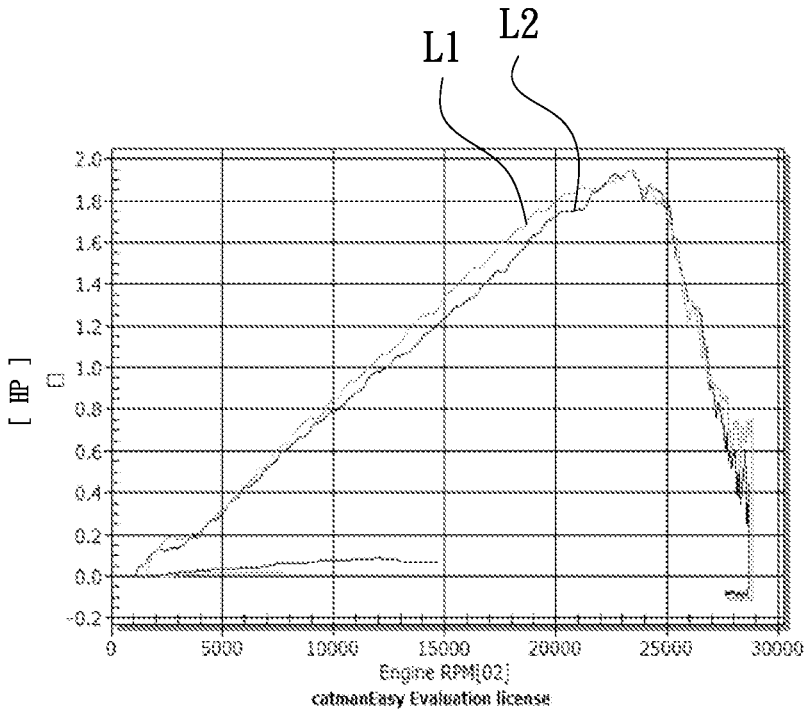
FIG. 11 is a comparative diagram showing the power outputs of the model engine with the cylinder liner having the grooved troughs of the present invention and the conventional model engine with the cylinder liner not having the grooved troughs at the same turning speed.

FIG. 11 is a comparative diagram showing the power outputs of the model engine with the cylinder liner having the grooved troughs of the present invention and the conventional model engine with the cylinder liner not having the grooved troughs at the same turning speed. The power output of the model engine of the present invention is L1, and the power output of the conventional model engine is L2. As shown in the comparative diagram, the power output of the model engine of the present invention is greater.

Figure 12:
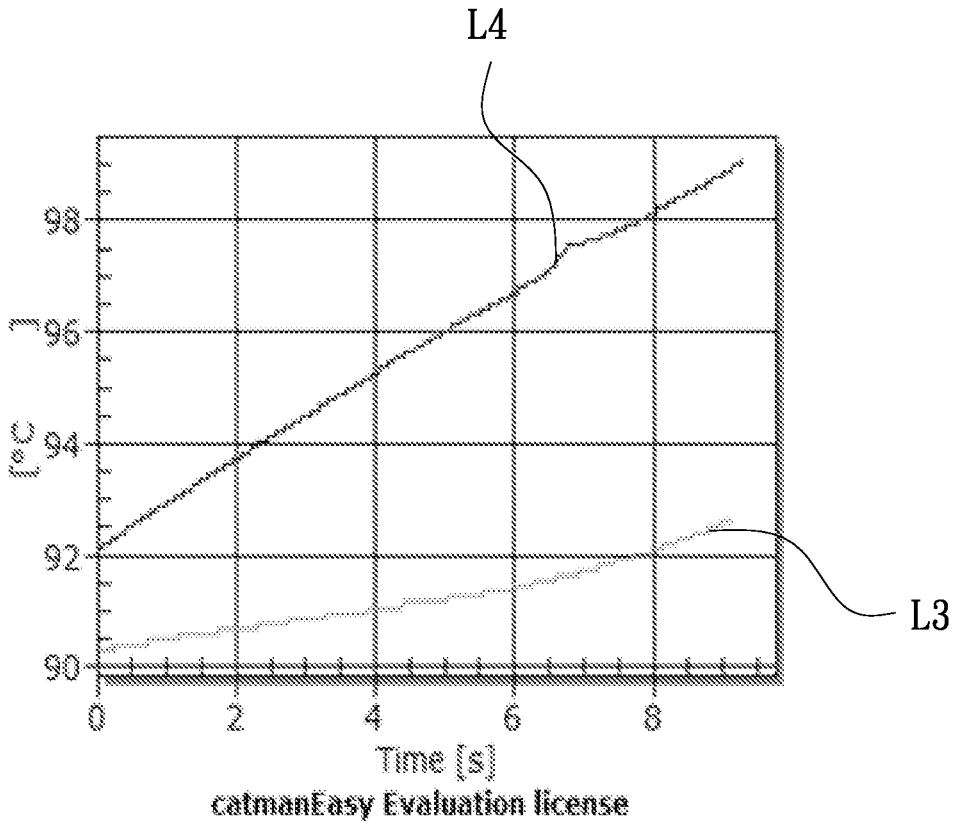
FIG. 12 is a comparative diagram showing the temperatures of the model engine with the cylinder liner having the grooved troughs of the present invention and the conventional model engine with the cylinder liner not having the grooved troughs at the same turning time.

FIG. 12 is a comparative diagram showing the temperatures of the model engine with the cylinder liner having the grooved troughs of the present invention and the conventional model engine with the cylinder liner not having the grooved troughs at the same turning time. The temperature curve of the model engine of the present invention is L3, and the temperature curve of the conventional model engine is L4. As shown in the comparative diagram, the temperature curve of the model engine of the present invention is lower.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A cylinder liner capable of oil storage and lubrication used for a model engine, the cylinder liner being disposed in a cylinder of the model engine, a piston being provided in the cylinder liner to reciprocate axially, an inner wall of the cylinder liner being honed to form a plurality of grooves, the grooves formed on the inner wall of the cylinder liner each having a depth in the range of 0.001 to 0.002 centimeters, and characterized in that:

the inner wall of the cylinder liner is further formed with at least one grooved trough, the grooved trough formed on the inner wall of the cylinder liner has a depth greater than the depth of the grooves, the depth of the grooved trough is in the range of 0.005 to 0.007 centimeters, and a bottom of the grooved trough is formed with a plurality of transverse stripes, such that the bottom of the grooved trough is ragged.

2. The cylinder liner capable of oil storage and lubrication used for a model engine as claimed in claim 1, wherein the cylinder liner is formed with an air inlet and an air outlet, and the grooved trough is located above the air inlet and the air outlet.

3. The cylinder liner capable of oil storage and lubrication used for a model engine as claimed in claim 1, wherein the inner wall of the cylinder liner is further radially formed with two grooved troughs, and a distance is defined between the two grooved troughs in the range of 2 to 3 centimeters.

* * * * *